US005560064A

United States Patent [19]

Goncalves Rocha

[11] Patent Number: 5,560,064

[45] Date of Patent: Oct. 1, 1996

[54] MULTIPURPOSE APPLIANCE-LORD

[76] Inventor: Manuel A. F. Goncalves Rocha, Apartado Postal No. 60.247, Caracas 1060-A, Venezuela

[21] Appl. No.: 359,728

[22] Filed: Dec. 20, 1994

[51] Int. Cl.[6] ..... A47K 7/02; A61H 7/00

[52] U.S. Cl. ..... 15/21.1; 15/97.1; 15/160; 15/210.1; 15/244.1; 4/606; 601/136

[58] Field of Search ..... 15/21.1, 97.1, 15/104.92, 160, 210.1, 244.1, 244.3; 4/606; 601/112, 114–117, 122, 134, 136, 154

[56] References Cited

U.S. PATENT DOCUMENTS

| | | | |
|---|---|---|---|
| 391,325 | 10/1888 | Mayer | 15/21.1 |
| 992,905 | 5/1911 | Robinson | 4/606 |
| 2,901,760 | 9/1959 | Nelson | 15/160 |
| 3,289,215 | 12/1966 | Kennedy | 4/606 |
| 3,478,369 | 11/1969 | Ensley | 4/606 |
| 4,071,021 | 1/1978 | Gallacci | 15/21.1 |
| 4,704,756 | 11/1987 | Williams et al. | 4/606 |

FOREIGN PATENT DOCUMENTS

| | | | |
|---|---|---|---|
| 488970 | 6/1992 | European Pat. Off. | 15/21.1 |
| 2347001 | 11/1977 | France | 4/606 |
| 2599614 | 12/1987 | France | 15/21.1 |
| 2426432 | 12/1975 | Germany | 4/606 |
| 2613947 | 10/1977 | Germany | 15/160 |
| 2834635 | 2/1980 | Germany | 15/160 |

*Primary Examiner*—Mark Spisich

*Attorney, Agent, or Firm*—Wigman, Cohen, Leitner & Myers, P.C.

[57] ABSTRACT

A multipurpose appliance for attaching to a wall an accessory used to clean, rub, massage or depilate areas of the body is disclosed. The appliance comprises a frame made of metal, plastic or any other suitable material having wall attachment. The cleaning-rubbing accessory may be slid in a vertical direction. The invention is provided with a fixing unit that allows the cleaning-rubbing accessory to be fixed at a desired height.

15 Claims, 1 Drawing Sheet

MULTIPURPOSE APPLIANCE-LORD

FIELD OF THE INVENTION

The present invention is directed to a device or appliance used to clean, rub, massage or depilate hair from areas which are not easily reached. The appliance may be installed on the wall of gyms and bathrooms. The appliance has fixed and movable pans, the latter being changeable according to the use that is needed at a given time.

BACKGROUND OF THE INVENTION

People throughout the world have experienced the difficulty of performing certain tasks, such as cleaning, rubbing or massaging one's back or any other movement in the area of the body. In use are such interesting devices shaped as a stick or bar of longer or shorter length with one end ending in a sponge or in the shape of a hand, usually with curved fingers in a position resembling the action for scratching. In other instances, individuals have satisfied this back scratching need by simply rubbing the area against the corner of a wall, furniture or door. Aside from the above mentioned stick device, other devices have been invented to clean, rub, soap and even sprinkle powder in the back area. However, all of these devices have present the same problem to localize the area without seeing it. This is even more difficult when a bar or stick is used, given that the extreme end cannot be controlled by feel resulting in a series of attempts not always successful.

SUMMARY OF THE INVENTION

The present invention has been carefully designed to respond to the aforementioned difficulties. It is fact that devices which must be used by moving the arm are not effective, first due to the difficulty in localizing the desired area: second, due to the small area covered by the device which must come in contact with the skin; third, because although these devices pretend to be an extension of the arm, they do not reach all the desired areas, but for a series of contortions. This invention attempts to solve the problem starting from the natural position, that is, the movement that instinctively is performed by any human being or any other living creature to rub the area of the body which is difficult to reach. In other words, the starting point is the movement of the body rubbing against a fixed element, a more effective and more comfortable way of satisfying this need. In essence, the basic part of the invention is a structure made of metal, plastic or any other material and preferably, waterproof to avoid corrosion, to be affixed to a wall at a variable height but within the average height of the back of an individual. The device is attached to the wall and on it a movable part will slide in a vertical direction which will allow the user to regulate the height of the cleaning, rubbing or massage unit at the wall, as well as to be the support of this last unit. This movable unit shall have a device for attachment in a fixed position at the desired height.

DETAILED DESCRIPTION OF A PREFERRED EMBODIMENT

Figure 1:
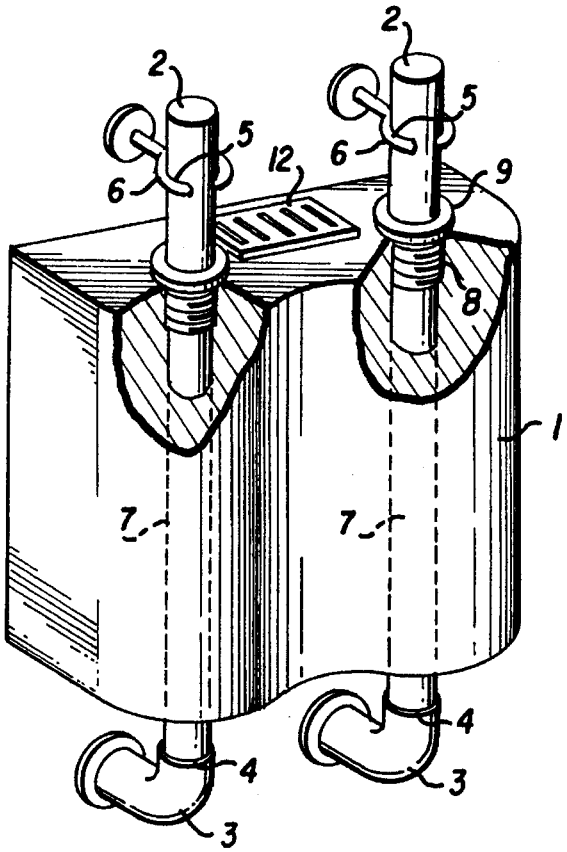
FIG. 1 illustrates a front view of the entirety of the present invention, including an inner view of the cleaning-rubbing accessory and all its parts.
Figure 2:
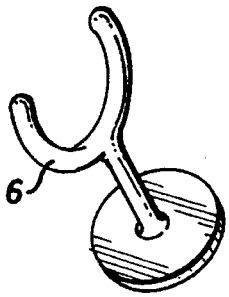
FIG. 2 is an enlarged view of the hook that allows the invention to be fixed on the wall.
Figure 3:
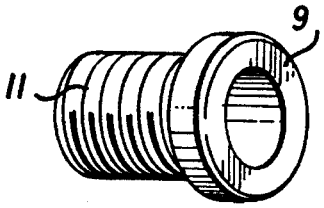
FIG. 3 is an enlarged view of the fixing device, that allows the cleaning-rubbing accessory to be fixed on the desired height.
Figure 4:
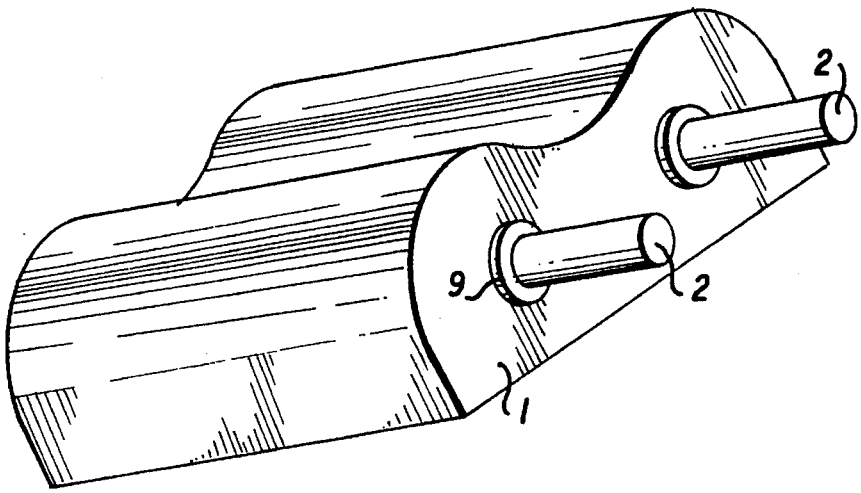
FIG. 4 is perspective elevation view of the invention.

Referring now in detail to the drawings wherein like parts are designated by like reference numerals throughout, there is illustrated in FIG. 1 a front view of the parts of the present invention, including an inner view of the cleaning-rubbing accessory 1, including two even ducts 7, each one provided with an inner screw thread 8 on its upper extreme. The fixing unit, comprising a ring 9 (FIG. 3), provided with an outer screw thread 11 on its lower extreme, will be placed on the parallel tubes 2 and freely slide up and down, then the parallel tubes 2 will be inserted through the ducts 7 allowing the cleaning-rubbing accessory 1 to freely slide up and down.

The support 3, which are previously fixed to the wall are each provided with a cavity (not shown) on its upper end 4, which allows the two parallel tubes 2 to be inserted on them, executing in this way its supporting function as to the invention.

The two parallel tubes 2 will be completely even, each one provided with a groove (not shown)in a portion 5, wherein the hooks 6, previously fixed to the wall, may hold them.

Once the invention is attached to the wall, the cleaning-rubbing accessory is ready to be placed at the desired height, by screwing the fixing device on the ducts of the cleaning-rubbing accessory, which performs pressure over the two parallel tubes, fixing the cleaning-rubbing accessory to the desired height.

The invention comprises the cleaning-rubbing accessory 1 including two ducts 7 with an inner screw thread 8 on its upper extreme; two parallel tubes 2, provided with grooves (not shown) on their upper ends 5; two supports 3 fixed to the wall, provided with a cavity on its extremes; two hooks 6 fixed to the wall; and two fixing units, comprising a ring 9 provided with an outer screw thread 11 on its lower extreme.

The cleaning-rubbing accessory 1 to be used with the present invention may carry different types of fixed or moving parts (not shown), such as sponges made by any synthetic or natural materials, depilatory papers, small rollers covered or not by brushes and sponges made by any synthetic or natural materials, brushes surrounded by cushions made by any synthetic or natural materials, cushions or pads for rubbing or massaging made by any synthetic or natural materials, and others; and may be provided with a tray 12 (FIG. 1) placed atop, for soap or any other cosmetic device.

To replace the cleaning-rubbing accessory, the user just needs to unhook the parallel tubes 2 from the hooks 6, separate the tubes 2 from the supports 3, pull the tubes 3 out of the used cleaning-rubbing accessory and place them in a new cleaning-rubbing accessory provided with the same system.

It is understood that the above description attempts to show the essential parts of the invention, rather than limit or restrict their design; therefore, any of its parts may vary without affecting the basics of the invention.

Although only preferred embodiments are specifically illustrated and described herein, it will be apparent to those skilled in the art to which the invention pertains that variations and modifications of the described embodiment may be made without departing from the spirit of the invention. Accordingly, it is intended that the invention be limited only to the extent required by the appended claims and the applicable rules of law.

What is claimed:

1. A device installed in a wall for treating areas of a body, comprising:

a cleaning/rubbing accessory having a top and a bottom;

at least one elongate member passing through said accessory from said top to said bottom, said at least one elongate member having a top portion and a bottom portion;

first support means fixed to the wall below said accessory for supporting said bottom portion of said at least one elongate member; and second support means fixed to the wall above said accessory for supporting said top portion of said at least one elongate member;

said first support means comprising at least one support fixed to said wall and having a top opening for receiving said bottom portion of said at least one elongate member;

said second support means comprising at least one hook fixed to said wall for receiving said top portion of said at least one elongate member.

2. The device claim 1, wherein said accessory includes a duct having a top portion, said top portion of said duct having an interior surface with an inner screw thread provided thereon.

3. The device of claim 2, further comprising a fixing ring having a bottom portion, said bottom portion of said fixing ring having an outer surface with an outer screw thread provided thereon.

4. The device of claim 3, wherein said duct is connected to said fixing ring via said inner screw thread and said outer screw thread.

5. The device of claim 3, wherein said fixing ring has a top portion which is open, said at least one elongate member comprising a tube which is inserted into said top portion of said fixing ring.

6. The device of claim 5, wherein said tube has a top portion having an outer surface with a groove formed therein, said at least one hook gripping said tube at said groove.

7. The device of claim 6, wherein said tube has a bottom portion which extends into and is received by said at least one support.

8. The device of claim 7, wherein said at least one support comprises a tubular support for receiving said bottom portion of said tube.

9. The device of claim 8, wherein said tubular support comprises an L-shaped tube.

10. The device of claim 5, wherein said tube has a bottom portion which extends into and is received by said at least one support.

11. The device of claim 10, wherein said at least one support comprises a tubular support for receiving said bottom portion of said tube.

12. The device of claim 11, wherein said tubular support comprises an L-shaped tube.

13. The device of claim 1, wherein said top portion of said at least one elongate member has an outer surface with a groove formed therein, said at least one hook gripping said elongate member at said groove.

14. The device of claims 13, wherein said first support means comprises at least one tubular support for receiving said bottom portion of said at least one elongate member.

15. The device of claim 1, wherein said first support means comprises at least one tubular support for receiving said bottom portion of said at least one elongate member.

* * * * *